US005248082A

United States Patent [19]

Elmlinger

[11] Patent Number: 5,248,082

[45] Date of Patent: Sep. 28, 1993

[54] TWO-WAY MAILER WITH PULL TAB

[75] Inventor: Gene L. Elmlinger, West Chester, Ohio

[73] Assignee: Bedinghaus Business Communications, Inc., Cincinnati, Ohio

[21] Appl. No.: 899,653

[22] Filed: Jun. 15, 1992

[51] Int. Cl.[5] ..... B65D 27/06

[52] U.S. Cl. ..... 229/303; 229/305; 229/306

[58] Field of Search ..... 229/71, 300, 301, 303, 229/305, 306

[56] References Cited

U.S. PATENT DOCUMENTS 759,382 5/1904 Klugh .
828,163 8/1906 Williams .
1,134,082 3/1915 Valasek .
1,245,447 11/1917 Felenchak .
1,303,063 5/1919 Hoock .
1,438,122 12/1922 McCoy .
1,827,507 10/1931 Brockett .
1,874,796 8/1932 Palm .
2,350,100 5/1944 Deutschmeister et al. .
2,927,723 3/1960 Johnson .
2,936,946 5/1960 Harpman .
2,983,421 5/1961 Turan .
3,062,431 11/1962 Rabenold .
3,312,385 4/1987 Amort .
3,365,117 1/1968 Powell, Jr. ..... 229/71
3,411,699 11/1968 Pine et al. .
3,419,288 12/1968 Noonan et al. .
3,420,432 1/1969 Cooper .
3,428,237 2/1969 Dowen .
3,507,519 4/1970 McNabb .
3,545,669 12/1970 Kinkade et al. ..... 229/300
3,693,869 9/1972 Eaves, Jr. .
3,899,127 8/1975 Melander .
3,952,942 4/1976 O'Leary .
3,981,435 9/1976 Johnsen .
4,011,985 3/1977 Simson .
4,190,162 2/1980 Buescher .
4,204,600 5/1980 Pritchard .
4,334,618 6/1982 Buescher .
4,384,670 5/1983 Dicker .
4,403,696 9/1983 Newell .
4,418,865 12/1983 Bowen .
4,602,736 7/1986 Barr .
4,669,652 6/1987 Sequin .
4,688,715 8/1987 Barr .
4,706,877 11/1987 Jenkins .
4,715,530 12/1987 Leese et al. .
4,741,475 5/1988 Norman .
4,744,508 5/1988 Fowler et al. .
4,747,535 5/1988 Haase et al. .
4,770,337 9/1988 Leibe .
4,778,101 10/1988 Paquin .
4,779,792 10/1988 Lombardo .
4,799,618 1/1989 Jenkins .
4,809,906 3/1989 Lombardo .
4,815,654 3/1989 Buescher .
4,824,142 4/1989 Dossche .
4,911,354 3/1990 Lombardo .
4,923,112 5/1990 Dale et al. .
4,984,733 1/1991 Dunn, Jr. ..... 229/301 X
4,993,624 2/1991 Schlich .
5,011,069 4/1991 Bowen et al. .
5,052,613 10/1991 Lin ..... 229/71 X
5,110,043 5/1992 Ashby ..... 229/304

*Primary Examiner*—Allan N. Shoap
*Assistant Examiner*—Jes F. Pascua
*Attorney, Agent, or Firm*—Wood, Herron & Evans

[57] ABSTRACT

A two-way mailer is constructed of top and bottom plies which form an outgoing and a return envelope, at least one insert ply secured between the top and bottom plies and a control ply overlying the top ply. The top ply bears the MAIL TO and the RETURN addresses for the outgoing envelope. The top ply also includes a die-cut removable pull tab. The insert ply includes a stationary portion adhered to the top ply around the outer perimeter of the pull tab. A section of the stationary portion located behind the pull tab bears the MAIL TO address for the return envelope. Removing the pull tab exposes the section and the MAIL TO address for the return envelope. With as few as three total plies, this two-way mailer can be consistently printed on an impact printer without any paper jams. Because the MAIL TO address for the return envelope remains concealed beneath the die-cut pull tab in the top ply, this mailer reduces user and postal confusion commonly caused by two separate MAIL TO addresses for the outgoing and return envelopes.

16 Claims, 3 Drawing Sheets

TWO-WAY MAILER WITH PULL TAB

FIELD OF THE INVENTION

This invention relates to a two-way mailer. More particularly, this invention relates to a two-way mailer which eliminates Post Office confusion commonly caused by two MAIL TO addresses.

BACKGROUND OF THE INVENTION

Over the last decade, a very significant trend has developed in the use of computer printers. More and more small, inexpensive impact printers are being installed in thousands of work places throughout the country. This trend toward smaller printers is expected to continue into the foreseeable future. While these small computer printers are very efficient and inexpensive, they have some limitations. More particularly, they are restricted in the thickness of the forms or mailers that can be processed through without experiencing paper jams, misfeeds, etc. For many of these printers, these problems are encountered if the mailer is greater than four plies.

A few years ago, a four ply self-mailer was developed specifically to run on these smaller impact printers. Four plies were used to eliminate difficulties in processing. This mailer was generally called a "reusable" mailer because the same paper plies were used to form the outgoing envelope and the return envelope. In short, this construction served to minimize the number of plies needed to construct a 2-way self-mailer that could be consistently run on small printers. This construction was widely used in the market.

This "reusable" mailer was normally constructed in two different versions. The first version typically contained both the outgoing MAIL TO or MAIL TO name and address and the RETURN name and address on the front of the envelope. The second version typically had the outgoing MAIL TO name and address on the front of the envelope and the RETURN name and address on the back of the envelope. In both versions, the RETURN address would appear in a position that could be mistaken for the MAIL TO address, thus resulting in the misdirection of the mailer.

In September, 1990, the U.S. Postal Service revised its mailing regulations regarding the design and use of reusable mailers. The new regulation stated that only one name and address could be visible in the MAIL TO zone on the front or the back of the envelope during any mailing. Both versions of the above-described reusable mailer became unusable due to these changes in the postal regulations.

Some manufacturers have introduced alternative constructions for reusable mailers. These newer constructions, however, have a major flaw. Namely, the number of plies required to create the outgoing envelope itself has been increased from two to three. When counting the insert and control plies, this increases the total number of paper plies in the mailer to five, instead of the previous four. This increase in plies causes the mailer to exceed many small printer recommended specifications. As mentioned previously, for many printers the use of more than four plies can cause jamming and create significant computer printing problems.

It is an objective of the invention to create a two-way reusable mailer that runs efficiently on small computer printers, and to comply with all current U.S. and Canadian postal regulations.

It is another objective of this invention to reduce the occurrence of confusion within postal facilities and others caused by the two MAIL TO addresses used on a two-way mailer.

SUMMARY OF THE INVENTION

This invention achieves the above-stated objectives with a three ply mailer which includes two outer plies which serve as an outgoing/return envelope and a single ply insert. A pull tab in a top ply of the envelope is removable by the recipient to expose a section of the insert ply which bears a MAIL TO address for the return envelope.

The top ply bears the MAIL TO and RETURN address for the outgoing envelope. When received, removal of an opening tear strip from the top ply opens the outgoing envelope and exposes a flap from the bottom ply which is foldable over the top ply to seal the return envelope. Folding and sealing of the flap covers up the original MAIL TO address for the outgoing envelope. Removal of the pull tab from the top ply exposes the new MAIL TO address for the return envelope. Thus, in both the outgoing and the return modes of the envelope, only one MAIL TO address is viewable on the top ply, thus conforming to current postal regulations.

This exposed section is part of the stationary portion of the insert ply which remains adhered between the two outer plies after the outgoing envelope is opened. This stationary portion remains permanently in the envelope. After opening the outgoing envelope, a removable portion of the insert ply separates from the stationary portion along a line of weakening. The stationary insert, or a portion thereof is adhered to the back of the top ply around the outside perimeter of the pull tab. Alternatively, perforations or other weakening lines are used to form the pull tab. The perimeter adhesive around the die-cuts prevents any possibility of the return MAIL TO address being obscured by one or more other plies inside the envelope.

Preferably, the stationary portion is also adhered between the two outer plies along one side marginal edge, opposite the side marginal edge at which the outgoing envelope is opened. This leaves a stationary portion of the insert ply with an L-shape. Alternatively, the stationary portion and the removable portion may be separate and distinct, with each portion held between the outer plies along a marginal edge. If it is not necessary to print the mailer on a small impact printer, it is also possible to have two overlapped and separate stationary and removable plies within the envelope.

A control ply may overlay the two envelope plies and the insert ply during impact printing. The control ply may depict, on its top surface, a layout for all of the information printed on the mailer. This layout may depict the relative positions of the outgoing MAIL TO and RETURN addresses, the incoming MAIL TO and RETURN addresses, an outgoing message, an incoming message, an account number and a postal indica area. This information will vary depending upon application. Underlying several of these regions, the control ply includes a transfer coating for manifolding onto the top ply when the mailer is run through an impact printer. Before the initial sending of the mailer, the control ply is removed and kept by the original mailer for record keeping purposes.

This two-way mailer may consist of as few as three plies. Including the control ply, this mailer includes four total plies. Thus, this mailer may be impact printed without jamming small printers. Because the MAIL TO address for the return envelope is hidden behind the pull tab of the top ply, this invention eliminates the confusion caused by two MAIL TO addresses on the outer surface of a two-way mailer. Perhaps, more importantly, the two-way mailer of this invention complies with all current U.S. and Canadian postal regulations.

According to one preferred embodiment of the invention, a two-way mailer includes a control ply, top and bottom plies which define the outgoing and reply envelopes and an insert ply secured between the top and bottom plies. An upper surface of the control ply may depict the layout of information printed upon the insert ply of the mailer. The bottom surface of the control ply includes a transfer coating in selected regions for printing information upon corresponding selected regions of the top ply when the mailer is run through an impact printer. The control ply and the top and bottom plies are identical in dimension, and these plies are formed from continuous overlying webs. The side marginal edges of the control ply and the top and bottom plies have feed strips which extend along the side edges of the webs. The feed strips include registration holes for aligning the webs during manufacture and feeding through impact printers. Transverse tear lines define the top and bottom edges of the mailer.

At one marginal side edge, the insert ply is adhered to both the top and the bottom plies. The insert ply also includes a tear line and a feed strip with registration holes located between the feed strips of the top and bottom plies. The top and bottom plies are secured together along their top and bottom marginal edges within the tear lines.

Spaced inwardly from the side marginal edge of the mailer which lies opposite the side marginal edge to which the insert ply is attached, the top and bottom plies include perforation lines. For the top ply, the perforation line defines line of separation between a body portion and a opening tear strip portion. For the bottom ply, the second perforation line defines a fold line located between a body portion and a fold flap portion.

Along this side marginal edge, the tear strip is secured to the bottom ply with a line of releasable adhesive, i.e., spot adhesive or fugitive adhesive. To open the outgoing envelope, the opening tear strip is pulled along the side marginal edge, thus tearing it from the body along the first perforation line and separating it from the releasably adhered flap of the bottom ply. With the tear strip removed, the free edge of the insert which extends beyond the first perforation line is accessible for removal from the outer envelope.

The insert ply includes at least one line of weakening which separates a removable portion of the same insert ply from a stationary portion of the insert ply. The stationary portion of the insert ply remains adhered between the top and bottom plies. The removable portion of the insert ply includes an informational area which delivers a message to the recipient. The removable portion of the insert ply may also include a reply message area for the recipient to mail back to the original sender or designate.

To manufacture this mailer, at least three continuous webs of paper are brought together after one of the intermediate webs has been die-cut to define the insert plies, which have smaller length and width dimensions than the other plies. Each of the webs is processed separately to provide the desired perforation lines, fold lines, lines of weakening and/or tear edges. Just before the webs are brought together, adhesive is applied to predetermined areas of the adjacently located webs.

With the webs which form the plies of each mailer die-cut and adhered together in a predetermined manner, the adhered webs are run through an impact printer. The impact printer causes information to be manifolded to the top plies from the control plies to print the MAIL TO and RETURN addresses on the top plies. If desired, the impact printer may also print an account number and a postal indica on the top ply.

According to one embodiment, the insert plies may be preprinted while in the initial web form, prior to die-cutting. The preprinted material on the insert ply includes the outgoing message, a location indication for the reply message and the MAIL TO address for the return envelope.

Preferably, an interior surface of the top ply includes transfer coating (i.e. carbonless paper coating, carbon tissue, opas, hot spot carbon, etc.) in regions which overly the outgoing message area, the reply message area and the MAIL TO address area for the return envelope. According to this embodiment of the invention, all of the printed matter for the mailer is impact printed in a single pass through the printer.

In use, after removal of the feed strips, the original sender removes the control ply from the mailer and retains it for record keeping. The outgoing envelope is then mailed. The top ply of the outgoing envelope includes the impact-printed MAIL TO and RETURN addresses.

Upon receipt, the recipient removes the opening tear strip from the top ply and tears the removable portion of the insert ply from the stationary portion by pulling on the free edge of the insert. The recipient may then read the outgoing message printed upon the removable portion. A reply section may be severable from the outgoing message section along the line of weakening, or additional inserts may serve as reply parts. The recipient fills out the reply information area and inserts it back between the top and bottom plies. An adhesive line along the flap of the bottom ply is then activated and the flap is folded over the first perforation line of the top ply to seal the return envelope. When sealed, the flap covers the MAIL TO address of the original, outgoing envelope. The pull tab is then torn from the top ply along the die-cuts or perforations, thereby exposing the MAIL TO address for the return envelope printed upon the stationary insert or stationary portion of an insert ply. Thus, both as an outgoing and a return envelope, this mailer reveals only one MAIL TO address at a time.

Of course, for commercial applications which require more than four plies, additional insert plies may be used.

These and other features of the invention will be more readily understood in view of the following detailed description and the drawings.

DETAILED DESCRIPTION OF THE DRAWINGS

Figure 1:
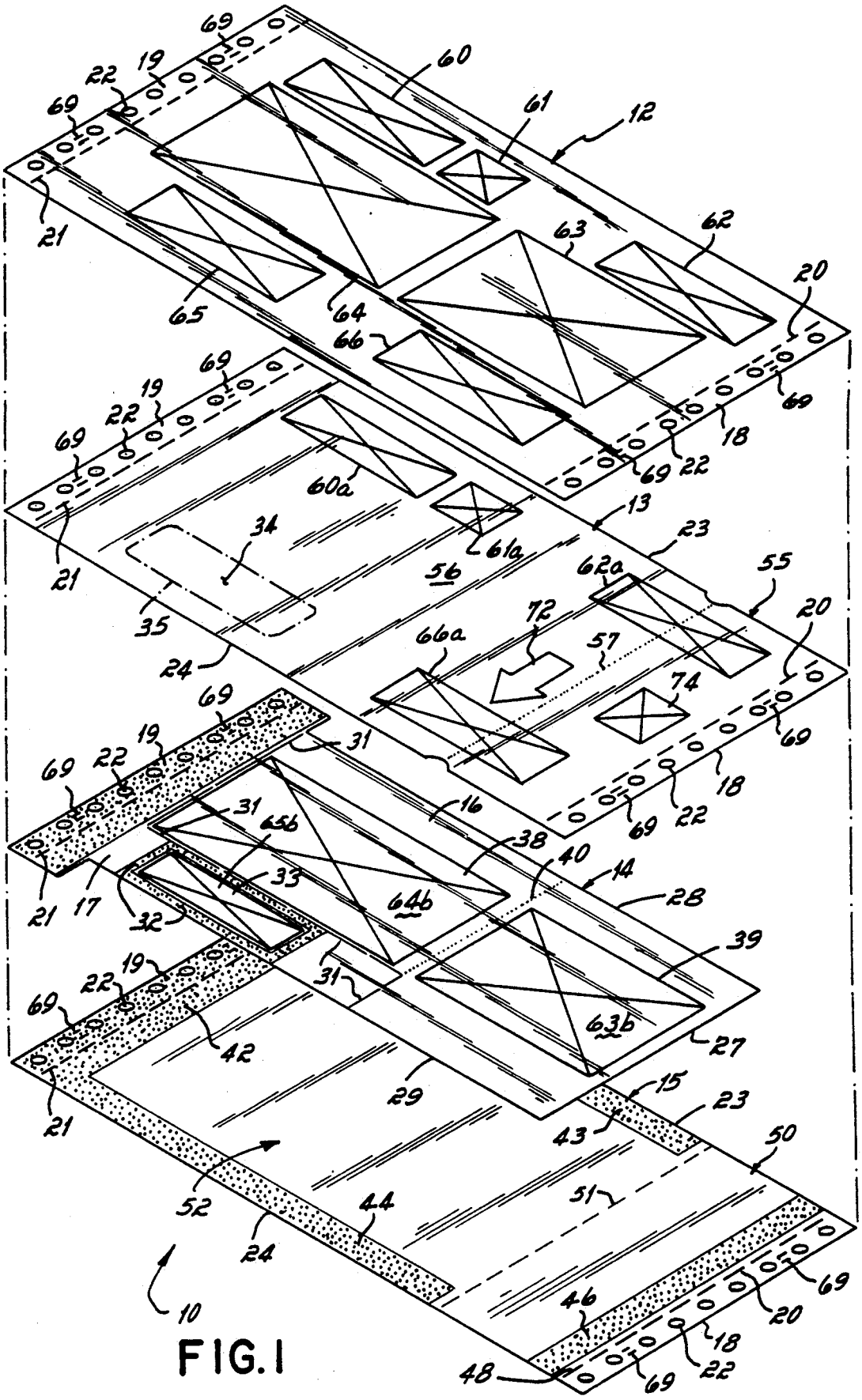
FIG. 1 is an exploded, perspective view of a two-way mailer constructed in accordance with one preferred embodiment of the invention.

FIG. 1 shows, in exploded perspective view, a mailer 10 constructed according a preferred embodiment of the invention. The mailer 10 includes a control ply 12, a top ply 13, an insert ply 14 and a bottom ply 15. The control ply 12 is kept by the initial sender for record keeping purposes The top ply 13 and the bottom ply 15 form both the outgoing and the return envelope. The insert ply 14 is located between top ply 13 and the bottom ply 15. The insert ply 14 includes a removable portion 16 which bears the outgoing message and the reply message and which is removed from the envelope upon receipt by the initial recipient. The insert ply 14 also includes an L-shaped non-removable portion 17 which is adhered to the top ply 13 and remains adhered to the top ply 13 when removable portion 16 is removed from the envelope.

All of the plies are formed from continuous paper webs which are brought together during manufacture. The control ply 12, the top ply 13 and bottom ply 15 include feed strips 18 and 19 along the longitudinal side edges. These feed strips 18 and 19 are located externally of tear lines 20 and 21, respectively, which define the first and second side marginal edges of the mailers 10. Feed strips 18 and 19 include guide or registration holes 22 for holding the plies in proper registration during manufacturing and during computer printing. To separate the mailers 10 from the four continuous paper webs, the control ply 12, the top ply 13 and the bottom ply 15 are severable along transverse tear lines (not shown) which define the top marginal edge 23 and bottom marginal edge 24 of the mailer 10.

The control ply 12, the top ply 13 and the bottom ply 15 are equal in length and width dimensions. The insert ply 14 may be equal or smaller than the other plies in both length and width dimensions. Along one side of the mailer 10, a free edge 27 of the insert ply 14 does not extend all the way to first side marginal edge 20. A top edge 28 of the insert ply 14 does not extend to top computer printing. To separate the mailers 10 from the four continuous paper webs, the control ply 12, the top ply 13 and the bottom ply 15 are severable along transverse tear lines (not shown) which define the top marginal edge 23 and bottom marginal edge 24 of the mailer 10.

The control ply 12, the top ply 13 and the bottom ply 15 are equal in length and width dimensions. The insert ply 14 may be equal or smaller than the other plies in both length and width dimensions. Along one side of the mailer 10, a free edge 27 of the insert ply 14 does not extend all the way to first side marginal edge 20. A top edge 28 of the insert ply 14 does not extend to top marginal edge 23, and a bottom edge 29 does not extend all the way to bottom marginal edge 24. The removable portion 16 of insert ply 14 is severable from stationary portion 17 along a line of weakening 31.

This line of weakening 31 extends parallel with second side marginal edge 21 of the mailer 10. The line of weakening 31 then extends parallel with bottom marginal edge 24 to a position across the width of the mailer 10. Finally, the line of weakening 31 extends downward again to bottom edge of the insert 14. The configuration of line of weakening 31 defines the shape of the stationary portion 17 of the insert ply 14. In the embodiment second side marginal edge 21. Reference numeral 32 designates the areas of insert ply 14 to which glue is applied to adhere to top ply 13. The section 33 is exposed when the pull tab 34 is removed from top ply 13 along the die-cuts 35. The section 33 bears the MAIL TO address for the return envelope.

Insert ply 14 preferably bears printed instructional information (not shown) on an outgoing message section 38 and on a reply message section 39 which is severable from the outgoing message section along a tear line 40. Another embodiment may include additional inserts of which one is used as a remittance ply. The printed information displayed on sections 33, 38 and 39 may be preprinted on the web from which the insert ply 14 is cut, or it may be completely blank and used as a generic mailer.

The top ply 13 and the bottom ply 15 are adhered along top marginal edge 23 and bottom marginal edge 24 by transverse glue lines 43 and 44, respectively. A longitudinal glue line 42 interconnects glue lines 43 and 44 along second side marginal edge 21. The glue line 42 adheres to the bottom surface of insert ply 1 along second side marginal edge 21. Along first marginal side edge 20, bottom ply 15 includes an resealable glue line 46. A releasable glue line 48 is located between the glue line 46 and the first side marginal edge 20. The resealable glue line 48 adheres top ply 13 and bottom ply 15 together along first side marginal edge 20 for the outgoing envelope. Resealable glue line 46 seals the return envelope. Glue lines 46 and 48 are applied to a flap portion 50 of the bottom ply 15. The flap 50 is defined by a perforation line 51 which serves as a fold line and separates the bottom ply 15 into a flap portion 50 and a body portion 52. Preferably, the top inside surface of flap 50 includes printed instructional information (not shown). The top ply 13 includes a tear strip 55 separable from a body portion 56 along a first perforation line 57. Perforation lines 51 and 57 are parallel.

The top surface of control ply 12 may be blank or may provide a mapped layout with a plurality of regions 60–66 which indicate the relative locations of all the printed information on the various plies of the mailer 10. Region 60 designates the corresponding location of top ply 13 where the RETURN address for the outgoing envelope is printed. Region 61 designates the location of the corresponding region on top ply 13 where an account number is printed. Region 62 designates the corresponding region on top ply 13 where postal indica may be printed. Region 63 indicates the area for the reply message. Region 64 indicates an area for the outgoing message. Region 65 indicates the corresponding position on the insert ply 14 for the MAIL TO address of the return envelope. Region 66 indicates the relative position on top ply 13 for the MAIL TO address of the outgoing envelope.

To accomplish impact printing, regions of the bottom surface of the control ply 12 which underlie regions 60–62 and 66 include a transfer coating. The transfer coating is either full or regionally coated to manifold information onto top ply 13 when the mailer 10 is run through an impact printer. Prior to bringing the webs together during manufacture, the insert ply 14 may be preprinted in the areas which correspond to regions 63, 64 and 65. The section of insert ply 14 which corresponds to reply message 63 will generally have space available for a written reply, along with a printed instruction indicating that it is the reply area.

Preferably, regions of the bottom surface of top ply 13 aligned with regions 63, 64 and 65 have transfer coating located thereon so that the corresponding areas of the insert ply 14 may also be printed when the mailer 10 is run through an impact printer.

Regions 60–62 and 66 may be colored with the same color, to indicate that these regions are printed onto top ply 13 when the mailer 10 is run through an impact printer. Regions 63, 64 and 65 may also be color coordinated, with a different color than regions 60–62 and 66.

Figure 2:
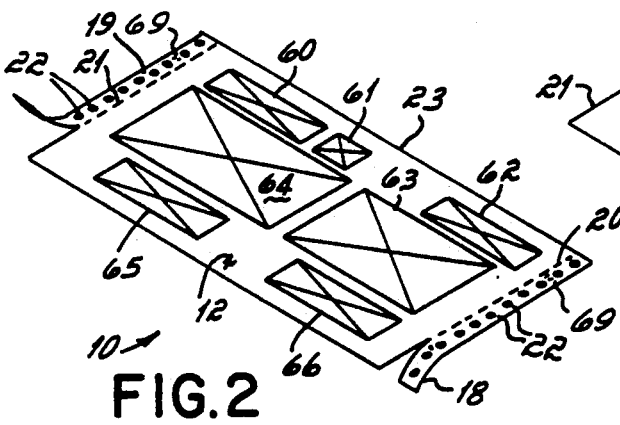
FIG. 2 is a perspective view of a two-way mailer constructed in accordance with a preferred embodiment of the invention, just after manufacture.

FIG. 2 shows a mailer 10 constructed in accordance with a preferred embodiment of the invention, just after manufacture. By removing feed strips 18 and 19 along tear lines 20 and 21, respectively, the control ply 12 is separated from the other plies of the mailer 10. Control ply 12 is not adhered to top ply 13, but remains connected thereto only because of several sets of crimps 69 punched through the feed strips 18 and 19 and located between the holes 22. With the feed strips 18 and 19 removed, or the mailer 10 having been processed through a decollating device, the control ply 12 is freed from the other plies. Control ply 12 is retained by the initial mailer for record keeping purposes. Feed strips 18 and 19 are discarded.

Figure 3:
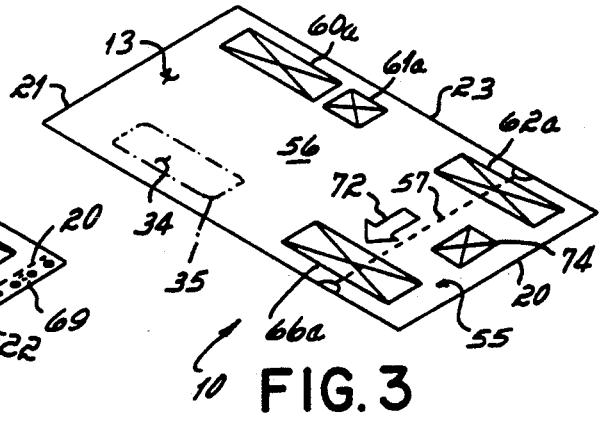
FIG. 3 shows the two-way mailer of FIG. 2 ready for use as an outgoing envelope.

This places the mailer 10 in condition for use as an outgoing envelope, as shown in FIG. 3. This outgoing envelope includes top ply 13, insert ply 14 and bottom ply 15. The outgoing envelope may include printed information in regions 60*a*, 61*a*, 62*a* and 66*a* which correspond to regions 60, 61, 62 and 66, respectively, of control ply 12. Region 60*a* bears the RETURN address for the outgoing envelope. Region 61*a* bears an account number. Region 62*a* bears postal indica for mailing the outgoing envelope to the initial recipient. Region 66*a* bears the MAIL TO address for the outgoing envelope. FIG. 3 also shows the die-cuts 35 which define pull tab 34. Preferably, pull tab 34 bears some printed information which indicates that it should be removed by the recipient prior to mailing the return envelope. If desired, top ply 13 may also include a reference arrow 72 or some other indication, such as the word "to", to call to the attention of the postal service the destination of the outgoing envelope. Finally, tear strip 55 of the top ply 13 should include a printed region 74 which includes instructions and/or illustrations which show how to remove the tear strip 55.

Figure 4:
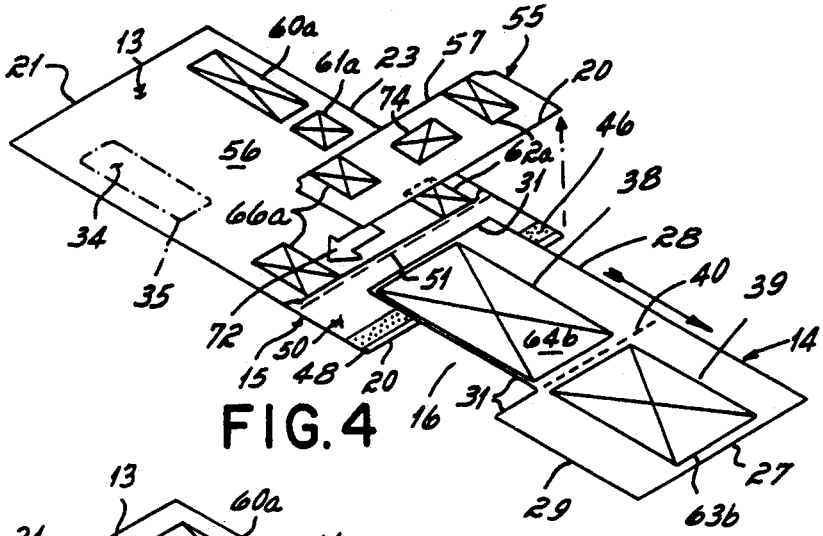
FIG. 4 shows the mailer of FIGS. 2 and 3, after the outgoing envelope has been opened and a removable portion of an insert ply has been removed from the envelope.

FIG. 4 shows tear strip 55 removed from the outgoing envelope. When tear strip 55 is pulled along first side marginal edge 20, it severs from body portion 56 along first perforation line 57 and also disconnects from bottom ply 15 along releasable glue line 48. With the tear strip 55 removed, the free edge 27 of insert ply 14 may be grasped and pulled to sever removable portion 16 from stationary portion 17 along line of weakening 31. With the removable portion 16 removed from the outgoing envelope, the initial recipient may read the outgoing message provided in region 64*b* of outgoing message section 38. The initial recipient may then sever the outgoing message section 38 from the reply message section 39 and print or write a reply in reply region 63*b*.

Figure 5:
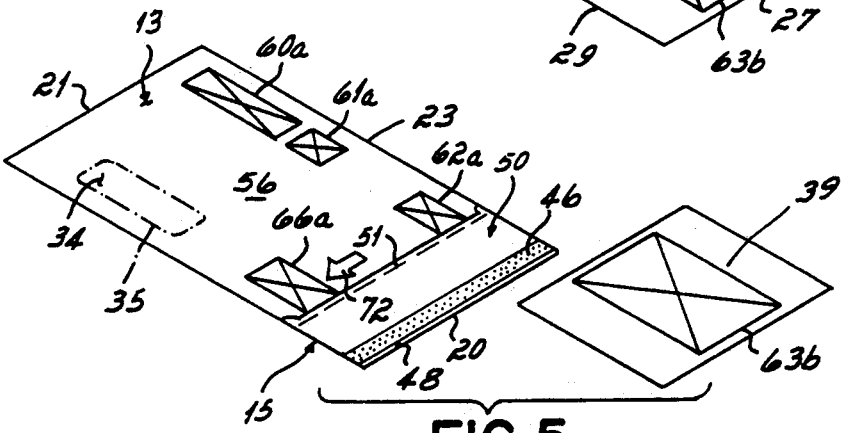
FIG. 5 shows the mailer of FIGS. 2–4, with a message reply section of the removable portion of the insert ready to be inserted into the return envelope.
Figure 6:
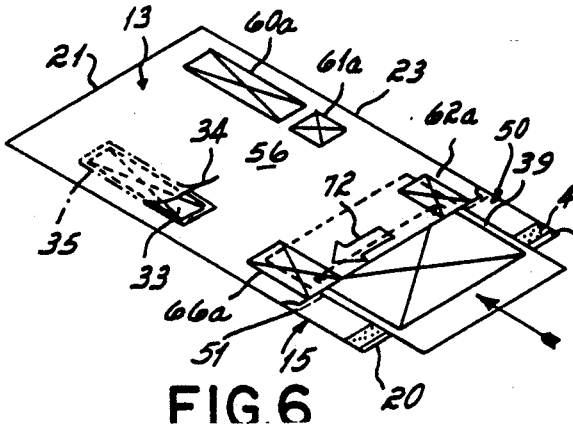
FIG. 6 shows the mailer of FIGS. 2–5, with the message reply section partially inserted in the return envelope and the die-cut pull tab partially torn away from the top ply.

FIG. 5 shows reply message section 39 severed from outgoing message section 38. With the reply printed in region 63*b*, the reply message section 39 may be inserted in between the top ply 13 and the bottom ply 15, as shown in FIG. 6. The resealable glue line 46 on flap 50 is folded over top ply 13 along perforation line 51 to seal the return envelope. Adhering flap 50 to top ply 13 covers the remainder of region 66*a* which bore the outgoing MAIL TO address and region 62*a* which bore the postal indica. Thereafter, pull tab 34 is torn along die-cuts 35 to expose the MAIL TO address for the return envelope printed upon section 33 of the insert ply 14.

Figure 7:
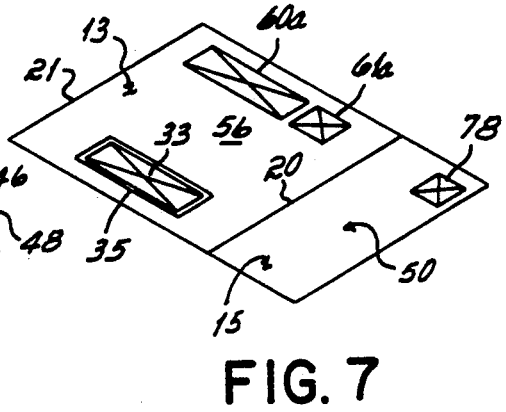
FIG. 7 shows the mailer of FIGS. 2–6 ready for use as a return envelope.

As shown in FIG. 7, the mailer 10 has been transformed into a return envelope ready to be mailed by the recipient back to the original mailer. The return envelope bears the MAIL TO address in exposed section 33 of the insert ply 14. The return envelope also bears the original RETURN address in region 60*a* and account number in region 61*a*. When folded over as a return envelope, perforation line 51 of bottom ply 15 becomes the outer side edge of the return envelope. The prior, first side marginal edge 20 of bottom ply 15 now extends parallel to the new edge 51, but is spaced inwardly therefrom. Preferably, a region 78 of the bottom ply 15 bears indica which indicates to the original recipient that postage must be placed on the return envelope prior to mailing.

Thus, this four-ply return mailer eliminates confusion associated with two MAIL TO addresses for a two-way mailer. In the outgoing mode, the outgoing MAIL TO address is printed on region 66*a* of top ply 13. During the return mode, the outgoing MAIL TO address in region 66*a* is obscured by the folded flap 50 which seals the return envelope. On the other hand, section 33 of insert ply 14, which bears the MAIL TO address for the return envelope, is concealed behind pull tab 34 when the outgoing envelope is sent. However, this section 33 is exposed to display the MAIL TO address for the return envelope when the pull tab 34 is removed. Thus, when the mailer 10 is used as an outgoing and as a return envelope, only one MAIL TO address appears on the top ply 13.

Figure 8:
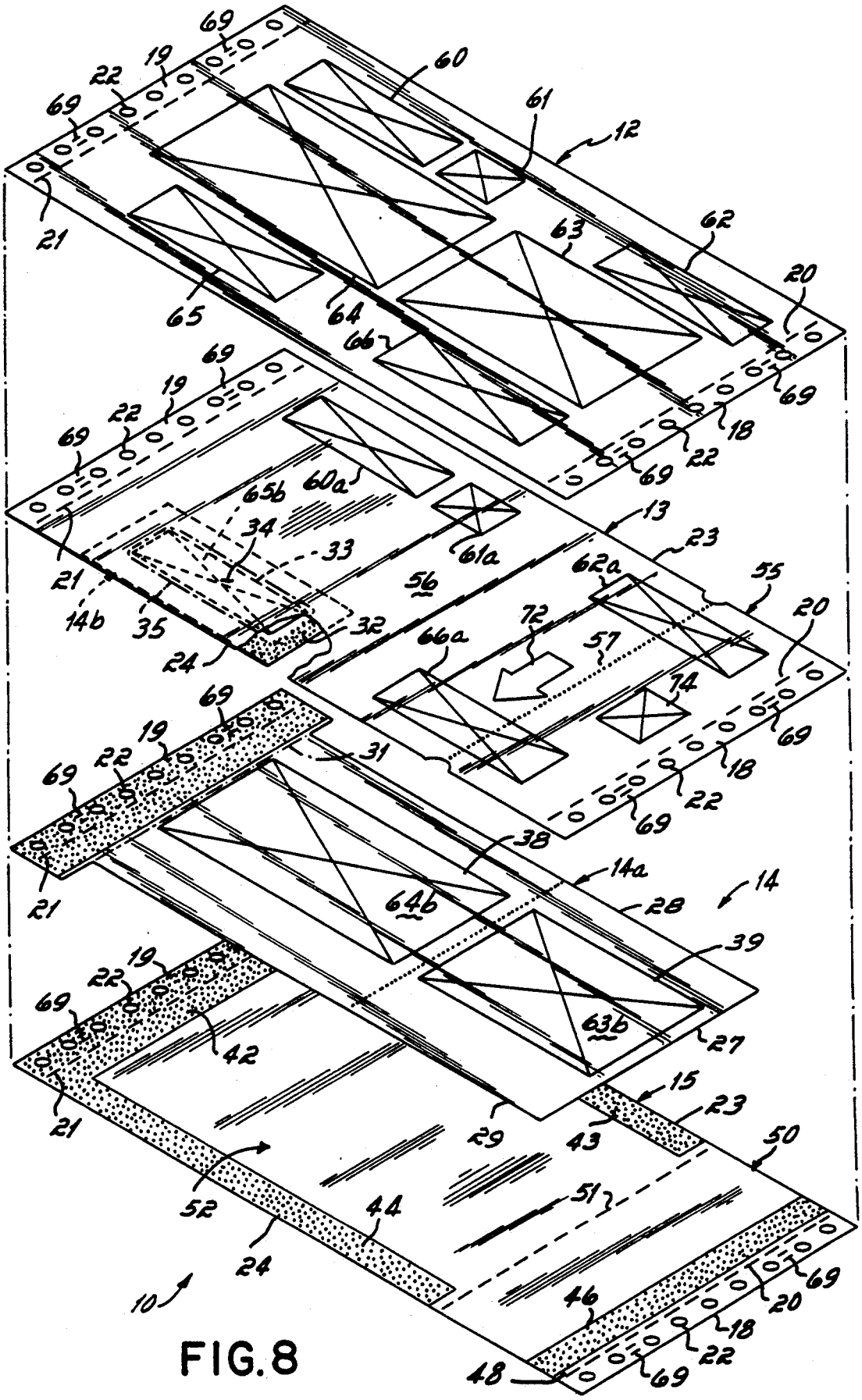
FIG. 8 is a perspective view of another embodiment of the two-way mailer of this invention utilizing one full-sized insert ply and a glued insert ply or patch.

As shown in FIG. 8, the mailer 10 may also be constructed With a full size removable insert ply 14*a* and a reduced-size glued patch 14*b*. Alternatively, a full-sized glued ply 14*b* could be used instead of the patch. Similar to the first embodiment, the glued patch or ply 14*b* includes the unadhered section 33 which is viewable through top ply 13 when the pull tab 34 is removed. The unadhered section 33 is surrounded by perimeter glue area 32. In this particular embodiment, the glued patch 14*b* is rectangular in shape and smaller in width than the removable ply 14*a* and is glued to the back of the top ply 13 along perimeter area 32. The patch or ply 14*b* remains in the envelope.

The removable ply 14*a* is located next to the stationary ply 14*b* and is removably held between the top ply 13 and the bottom ply 15 along a line of weakening 31 parallel with the second side marginal edge 21. Alternatively, removable ply 14*a* could have free edges and be temporarily held to one of the other plies by fugitive glue.

If one or more insert plies overlap, as shown in FIG. 8, they must be formed from different webs, and the total number of plies for the mailer 10 will be greater than four. For variations of this type, the only restriction relates to the requirement that the perimeter glue area 32 completely surround unadhered section 33.

While two preferred embodiments of the invention have been described, it is to be understood that applicant does not wish to be limited thereby and that the scope of the invention contemplates some variation and/or modification from the preferred embodiments. For instance, the opening tear strip may be formed as part of the back ply, or located along the top or bottom edge, rather than the side edge. Additionally, rather than one opening tear strip, the mailer may incorporate a pair of strips along a top, bottom or side marginal edge to provide a burst open mailer.

I claim:

1. A two-way mailer comprising:

a pair of outer plies adhered together to define an outgoing and a return envelope; one of the plies including a removable pull tab having a perimeter; and at least one insert ply located between the other plies, the insert ply including a stationary portion adhered to said one ply around the outside of the perimeter of the pull tab and a removable portion separable from the stationary portion along a line of weakening, the stationary portion including an exposed section which is viewable through said one ply when the pull tab is removed therefrom, the exposed section bearing a MAIL TO address for the return envelope.

2. The mailer of claim 1 wherein the stationary portion of the insert ply extends along one side marginal edge of the mailer, between the outer plies.

3. The mailer of claim 1 wherein the stationary portion of the insert ply extends along one side marginal edge of the mailer, between the outer plies, thereby defining an L-shaped stationary portion of the insert ply.

4. The mailer of claim 1 wherein a first of said outer plies bears a MAIL TO address and a RETURN address for the outgoing envelope said first ply further includes a tear strip separable from said outer plies along a first perforation line to open the outgoing envelope and to provide access to the insert ply, a flap of the second of the pair of outer plies adapted to fold over the first perforation line to seal the return envelope and also to cover the MAIL TO address for the outgoing envelope.

5. The mailer of claim 4 wherein said one ply is the first ply

6. The mailer of claim 4 and further comprising:

a control ply overlying the first ply, the control ply including selectively activatable printing means thereon in surface contact with the first ply for printing the MAIL TO and RETURN addresses for the outgoing envelope on the first ply when the mailer is fed through an impact printer.

7. The mailer of claim 6 wherein the exposed section of the insert ply bears a preprinted MAIL TO address for the return envelope.

8. The mailer of claim 6 wherein an interior surface of the removable pull tab includes activatable printing means thereon in surface contact with the exposed section of the insert ply for printing the MAIL TO address for the return envelope on the exposed section of the insert ply when the mailer is fed through an impact printer.

9. A two-way mailer comprising:

a first ply having a body and an opening tear strip located along a first side marginal edge thereof, the body and the tear strip being separable along a first perforation line, the first ply including a die-cut removable pull tab having a perimeter;

a second ply adhered to the first ply to form an outgoing envelope, the second ply having a body and a flap located along the first side marginal edge, the body and flap being separated by a second perforation line which is parallel with the first perforation line, the first ply bearing MAIL TO and RETURN mailing addresses for the outgoing envelope;

the opening tear strip being removable from the first ply along the first perforation line to open the outgoing envelope, the flap having activatable adhesive thereon adapted to adhere to the first ply when folded thereover about the first perforation line to cover the outgoing MAIL TO address and to seal the return envelope; and an insert ply located between the first and second plies, the insert ply having at least one line of weakening, the line of weakening defining a stationary portion that is adhered between the first and second plies around the outside of the perimeter of the pull tab and a removable portion that is separable from the stationary portion along the line of weakening when the outgoing envelope is opened, the stationary portion having a section which is viewable through the first play when the pull tab is removed and which bear a MAIL TO address for the return envelope.

10. The mailer of claim 9 wherein the insert is adhered between the first and second plies along a second side marginal edge located opposite the first side marginal edge thereof.

11. The mailer of claim 10 wherein the stationary portion is L-shaped.

12. The mailer of claim 10 and further comprising:

feed strips detachably connected to the first and second plies along the first and second side marginal edges thereof and a detachable feed strip connected to the insert along the second side marginal edge.

13. The mailer of claim 9 wherein a free edge of the insert is located between the first perforation line and the first side marginal edge.

14. The mailer of claim 9 wherein the tear strip is releasably adhered to the second ply.

15. The mailer of claim 9 wherein the tear strip includes a cut out to facilitate opening of the outgoing envelope.

16. A two-way mailer comprising:

two plies adhered together to form an envelope;

a removable pull tab formed in one of said plies;

a first insert ply adhered to said one ply inside the envelope, the insert ply having an unadhered section underlying the pull tab and an adhered section surrounding an outside perimeter of the unadhered section; and activatable printing means located on an inside surface of said pull tab, thereby to print a MAIL TO address for a return envelope upon said unadhered section when the mailer is run through an impact printer.

* * * * *